US006116855A

United States Patent [19]

Maki

[11] Patent Number: 6,116,855

[45] Date of Patent: Sep. 12, 2000

[54] FLEXIBLE IMPELLER REMOVAL SYSTEM

[75] Inventor: Bruce A. Maki, Hugo, Minn.

[73] Assignee: Hypro Corporation, St. Paul, Minn.

[21] Appl. No.: 09/123,060

[22] Filed: Jul. 27, 1998

[51] Int. Cl.[7] ..... F04D 29/62; F04D 29/20; F04D 29/22

[52] U.S. Cl. ..... 416/146 R; 416/240; 416/244 R; 415/141; 29/264

[58] Field of Search ..... 416/244 R, 244 A, 416/244 B, 245 R, 245 A, 245 B, 204 R, 146 R, 132 R, 240; 415/216.1, 141; 29/264, 263

[56] References Cited

U.S. PATENT DOCUMENTS

| | | | |
|---|---|---|---|
| 1,753,780 | 4/1930 | Fisher | 29/264 |
| 1,824,033 | 9/1931 | Brenneman et al. . | |
| 1,895,448 | 1/1933 | Cornwell . | |
| 1,953,297 | 4/1934 | Good | 416/244 R |
| 2,441,432 | 5/1948 | McGee | 415/216.1 |
| 2,899,902 | 8/1959 | Bandli et al. | 415/141 |
| 2,916,813 | 12/1959 | Belanger . | |
| 3,054,355 | 9/1962 | Neely | 416/240 |
| 3,058,207 | 10/1962 | Wilson . | |
| 3,136,370 | 6/1964 | Carlson | 416/244 B |
| 4,065,844 | 1/1978 | Lieser et al. | 29/264 |
| 4,392,779 | 7/1983 | Bloemers et al. | 415/141 |
| 4,411,593 | 10/1983 | Taguchi | 416/244 B |
| 4,417,855 | 11/1983 | Jepsen | 416/244 A |
| 4,538,962 | 9/1985 | McCain | 416/146 R |
| 4,633,562 | 1/1987 | Ulsh . | |
| 5,054,179 | 10/1991 | Rini . | |
| 5,341,553 | 8/1994 | Herzhauser . | |
| 5,416,963 | 5/1995 | Boynton . | |
| 5,718,028 | 2/1998 | Hasenberg . | |

FOREIGN PATENT DOCUMENTS

| | | | |
|---|---|---|---|
| 323642 | 5/1918 | Germany | 416/244 R |
| 2550034 | 5/1977 | Germany | 416/244 A |

*Primary Examiner*—Christopher Verdier
*Attorney, Agent, or Firm*—Nikolai, Mersereau & Dietz, P.A.

[57] ABSTRACT

A flexible impeller has an insert design incorporating a threaded end within its insert that cooperates with a threaded removal tool for jacking the impeller from the shaft by rotation of the threaded removal tool.

2 Claims, 2 Drawing Sheets

FLEXIBLE IMPELLER REMOVAL SYSTEM

FIELD OF THE INVENTION

This invention relates to flexible impeller pumps and other rotary pumps using an impeller installed upon a shaft and more particularly to a device and method for removing the impeller from the shaft.

BACKGROUND OF THE INVENTION

Flexible rubber impeller pumps are used in the marine industry as raw water coolant pumps for diesel and gasoline internal combustion engines. They draw water from the lake or ocean and either pump it to the engine directly as in the case of pleasure boat engines or through a heat exchanger as in the case of larger diesel engines. The rubber impeller in this variety of a pump consists typically of an insert of a metal or plastic around which a rubber impeller incorporating a number of blades is molded. The impeller is mounted on a shaft and is driven by means of a key, spline or a flat on the shaft. In the "new" condition, the impeller is free to move axially on the shaft such that the impeller will find its center position. The rubber impeller must be periodically replaced due to wear and deterioration over time. Most manufacturers of flexible rubber impeller pumps recommend that the impeller be replaced annually before the beginning of a new boating season.

Changing an impeller at a properly equipped repair facility or marina when the boat is in port usually does not present a problem. However, often the marine engine is not serviced as specified or the impeller fails prematurely from various environmental reasons such as the pump suction being blocked or running in an adverse environment such as silt and sand. When such failures occur, the engine overheats and the boat crew is required to change the impeller on the pump under less than ideal conditions which include a hot engine and a cramped engine compartment, inadequate tools and possibly a boat which may be adrift in rough seas and foul weather. The removal of the impeller is further complicated by the presence of corrosion and build up of deposits between the impeller insert and the shaft.

The typical method for impeller removal requires the use of a pliers. After removing the cover plate on the pump housing and exposing the end of the impeller to the operator, two pairs of pliers are used by the operator to grip the blades of the impeller. A strong hold is required to remove the impeller from the pump housing. This method works reasonably well on a work bench where the mechanic can assume a good stance and use both arms to advantage. A stubborn impeller can also be assisted along by prying it with screwdrivers.

A number of removal tools have been marketed over the years to assist in the removal of rubber impellers. Typically they are similar to bearing pullers with a modification on three or four legs for gripping the impeller. These removal tools are expensive and usually found at marinas. They are rarely used by average boaters or, for that matter, found in a tool box of average boaters. The average boater must therefore rely upon his or her trusty pliers to pull the impeller from the housing, a task which can be challenging when performed over a hot engine on a rocking boat and a cramped engine well and using both hands. Therefore what is needed is a flexible impeller with an improved insert that allows it to be readily removed from the pump.

Thus, the primary object of the present invention is to provide a flexible impeller with an insert designed for easy removal of the impeller under adverse conditions, by using inexpensive items found at a hardware store or work bench as the removal tool.

A further object of the present invention is to provide a flexible impeller that can be readily removed with one hand using only a threaded tool to engage the insert of the impeller and removing the impeller by simply rotating the tool.

Yet another object of the present invention is to provide a flexible impeller with an improved design that modifies the traditional insert for securing the impeller to the pump drive shaft by including an arrangement which allows the impeller to be readily removed with a conventional threaded tool.

SUMMARY OF THE INVENTION

The present invention is an improved flexible impeller that enables an operator to easily remove the impeller from the pump after extensive use. The rubber impeller includes a tubular insert of metal or plastic. The insert extends the full length of the impeller with the pump drive shaft extending only a predetermined distance along the insert bore. The drive shaft of the pump engages the impeller insert by means of either a spline, key, drive flat or other conventional means. The remaining portion of the insert bore is threaded. Removal of the tool is accomplished by first threading a bolt into the threaded section. The bolt contacts the pump shaft end and will drive on the end of the shaft jacking the impeller out of the pump housing. The removal can be accomplished with one hand with a wrench or a socket wrench used to drive the impeller out with the mechanical advantage gained with the use of the threaded end. Alternatively, a simple inexpensive tool with a threaded end and a bend to provide for a handle may be provided with the replacement impeller.

DESCRIPTION OF THE DRAWINGS

These and other objects and advantages of the present invention will become readily apparent to those skilled in the art from the review of the following detailed description of the preferred embodiment, especially when considered in conjunction with the accompanying drawings in which like numerals in the several views refer to the corresponding parts.

DETAILED DESCRIPTION OF THE PREFERRED EMBODIMENT

Figure 1:
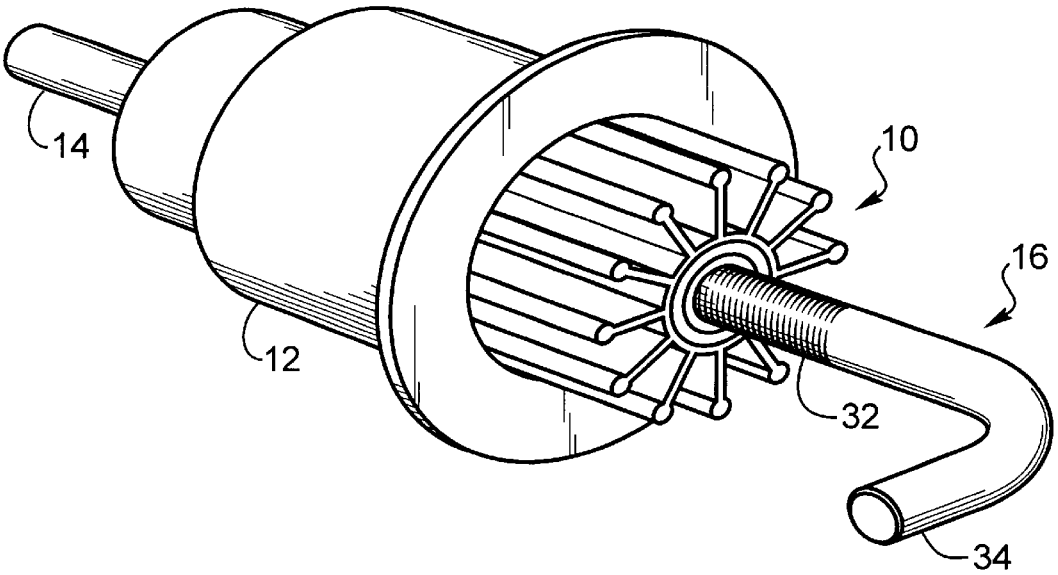
FIG. 1 is perspective view of a pump housing with the impeller of the present invention partially removed by the tool of the present invention.

The present invention is an impeller designated 10 in FIG. 1 shown partially removed from a pump housing 12. The impeller is of the type used in flexible impeller pumps or other rotary pumps using an impeller installed upon a shaft and is preferably made out of a suitable rubber material. The impeller 10 is coupled to a shaft 14 which in turn is connected to the pump motor (not shown). Also shown in FIG. 1 is a threaded bolt or removal tool 16 which is used to remove impeller 10.

Figure 2:
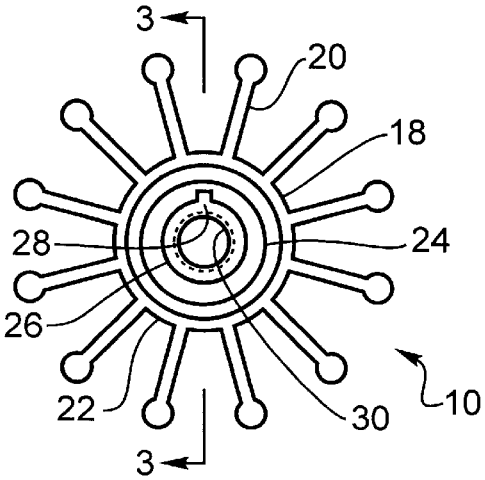
FIG. 2 is an end view of the impeller of the present invention.
Figure 3:
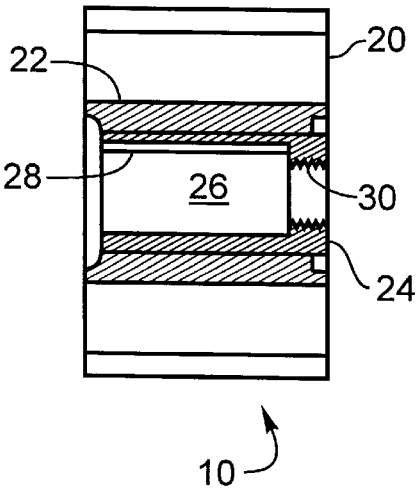
FIG. 3 is a cross sectional view along line 3—3 of FIG. 2.

Turning now to FIGS. 2 and 3, impeller 10 has a tubular body 18 with a plurality of radially extending blades designated 20. The impeller blades 20 and impeller body 18 are preferably made of a flexible or rubber material. Located within bore 22 of the tubular body 18 is a tubular insert 24 that may be metallic or rubber. The insert has a bore section 26 for receiving pump drive shaft 14. A key drive slot 28 is located along section 26 for coupling the impeller 10 to the pump drive shaft 14 or any other suitable shaft connection may be used as known to those of skill in the art. The remaining section 30 of the insert bore is threaded with standard conventional thread size, such as those found in the Standard Unified Thread Series commonly used in the United States or the Metric Screw Thread series commonly used in Europe and Japan.

Figure 4:
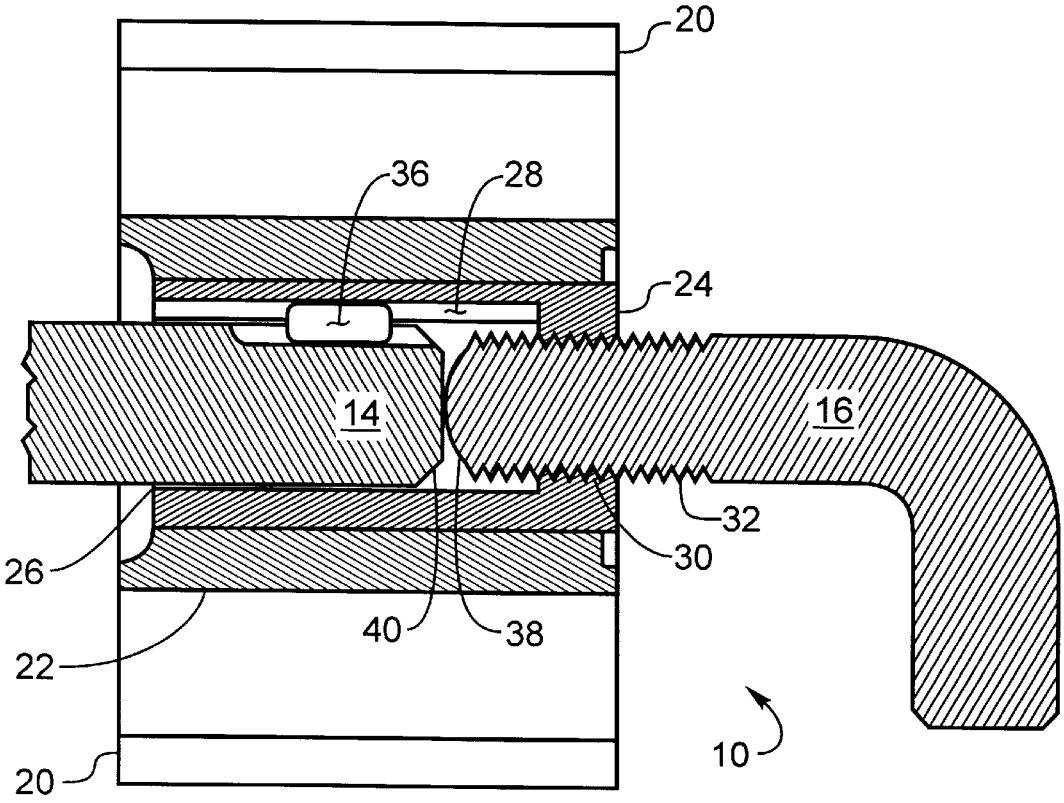
FIG. 4 is a cross-sectional view of the shaft, impeller insert and threaded tool of the present invention.

The improved impeller 10 of the present invention requires a threaded removal tool 16 as seen in FIGS. 1 and 4. This threaded tool 16 includes a threaded shaft 32 at one end with a handle 34 opposite the threaded shaft 32 to assist in manipulating and rotating tool 16. The threads on tool 16 mate with the threads of the impeller bore section 30. Tool 16 can be specially made as shown in the figures or it can be a conventional threaded tool such as a bolt, wrench or socket wrench.

The installation and removal of the impeller 10 will now be described. The impeller 10 is first inserted into the pump housing 12 such that key 36 on the pump drive shaft 14 engages slot 28 located within the insert bore section 26. Once the shaft 14 is properly secured to the impeller 10, the pump can be operated until the impeller 10 needs to be replaced. The impeller 10 is removed by using the threaded tool 16. The operator inserts the threaded end tool 16 into the threaded section 30 of the bore 22. The shaft 14 is rotated into the bore 22. When end 38 of tool 16 reaches the inner most shaft end 40 as seen in FIG. 4, the operator continues to rotate the tool 16. As this occurs, the threaded section continues to travel along the threaded section 32 of the tool 16 pulling the impeller 10 off the drive shaft 14. Once removed, the impeller 10 may be discarded and a new one placed on the pump shaft 14.

This invention has been described herein and in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without parting from the scope of the invention itself.

What is claimed is:

1. A replaceable flexible impeller for inserting in a pump housing comprising:

a replaceable flexible impeller member having a central core and a plurality of flexible impeller blades extending radially outward from the central core for pumping a fluid in the pump housing, the replaceable flexible impeller member having a bore of a first diameter in a first portion of the central core and a threaded bore of a second diameter adjacent the bore of the first diameter and extending through to the other side of the core, the second diameter being smaller than the first diameter, a tool having a handle and a shaft with threads thereon for engaging the threads in the core such that when the tool is rotated in the core it will push against a shaft in the core and extract the replaceable flexible impeller from the housing.

2. A replaceable flexible impeller for inserting in a pump housing as in claim 1 wherein, the bore in the first portion of the core has a key slot.

* * * * *